United States Patent [19]

Lundgren

[11] Patent Number: 4,648,645

[45] Date of Patent: Mar. 10, 1987

[54] AUTOMATIC CONTAINER SPREADER

[76] Inventor: Sven-Olov Lundgren, 20 Dixon St., Royal Park, South Australia, Australia, 5014

[21] Appl. No.: 729,796

[22] PCT Filed: Jul. 20, 1984

[86] PCT No.: PCT/AU84/00142

§ 371 Date: Mar. 22, 1985

§ 102(e) Date: Mar. 22, 1985

[87] PCT Pub. No.: WO85/00578

PCT Pub. Date: Feb. 14, 1985

[30] Foreign Application Priority Data

Jul. 21, 1983 [AU] Australia ..... PG0398

[51] Int. Cl.[4] ..... B66C 1/66

[52] U.S. Cl. ..... 294/81.53

[58] Field of Search ..... 294/81.53, 81.1, 81.3, 294/81.4, 81.5, 81.51, 81.52, 81.54, 81.55, 67.1, 68.1, 82.24; 414/607, 608

[56] References Cited

U.S. PATENT DOCUMENTS 3,712,661 1/1973 Strand ..... 294/81.53

3,888,536 6/1975 Durenec ..... 294/81.53

4,258,949 3/1981 Keagbine ..... 294/81.53

4,521,044 6/1985 Appleman ..... 294/81.53

*Primary Examiner*—James B. Marbert

*Attorney, Agent, or Firm*—Brown, Martin, Haller & Meador

[57] ABSTRACT

A spreader which is useful for hoisting a container, for example with a crane or hoist, and being spective to transmit a lifting force to twist lock blocks located at the corners of the container when engaged by the respective twist locks carried by the frame of the spreader, comprising a lifting member (21), lifting cables (44) between the lifting member and the spreader frame (11), an indexing head (30) between the indexing head and the lifting member, coupling means arranged to rotate the twist locks (16, 17) simultaneously upon lifting forces being applied, and inhibit means (52, 57) arranged so that if any one of the twist locks does not rotate to a locked position upon the lifting force being applied, the inhibit means inhibits movement of the coupling means which in turn prevents the indexing head from rotating and thereby all other twist locks are prevented from rotation.

8 Claims, 5 Drawing Figures

AUTOMATIC CONTAINER SPREADER

This invention relates to a spreader which is useful for hoisting a container, for example with a crane or hoist.

Containers which are made according to International Standard Organisation specifications have four lifting blocks of hollow construction, one at each corner, each lifting block having a rectangular opening in which a key end of a twist lock may be inserted, the twist lock having a rectangular section key on the end of a spindle which, upon insertion and rotation, engages the walls of the opening and allows a lifting force to be applied for lifting the container.

When a container is to be lifted. a spreader frame is used having respective twist locks at each of four corners, and the spreader frame is lifted by the hook of a crane which engages a central lifting location, thereby lifting the container without applying side forces to the twist locks.

The spreaders which are presently used are occasionally unreliable, in that a spreader can still accept the weight of a container even though all twist locks are not properly located within the receiving blocks, and the main object of this invention is to provide a spreader and twist lock assembly wherein the danger of malfunction is reduced. A second object is to provide means which will reduce the amount of labour requirement.

In this invention a spreader for transmitting a lifting force to twist lock blocks located at respective corners of a container when engaged by respective twist locks carried by the frame of the spreader, comprises a lifting member, lifting cables extending from the lifting member to the spreader frame, an indexing head on the spreader frame, spring means between the indexing head and the lifting member, coupling means coupling the indexing head to respective said twist locks arranged to rotate the twist locks simultaneously upon said lifting force being applied, and inhibit means operable between each respective said twist lock and the frame arranged such that if any one of the twist locks does not rotate to a locking position upon said lifting force being applied, the inhibit means inhibits movement of the coupling means which in turn disables the indexing head from rotation and thereby all other twist locks are prevented from rotation.

With this arrangement, every twist lock is in the same position of locking, and partial engagement of one only of the twist locks in its receiving aperture in its respective block is avoided.

While the invention provides a safe and more secure lifting device than has previously been available, it is nevertheless desirable that an operator should have visual means of ensuring that there has been no malfunction and in one embodimnt of this invention, each twist lock is associated with a visible pointer which indicates movement from an unlocked position to a locked position when the twist locks are rotated into their locked position, and vice versa.

An embodiment of the invention is described hereunder in some detail with reference to, and is illustrated in, the accompanying drawings, in which.

Figure 1:
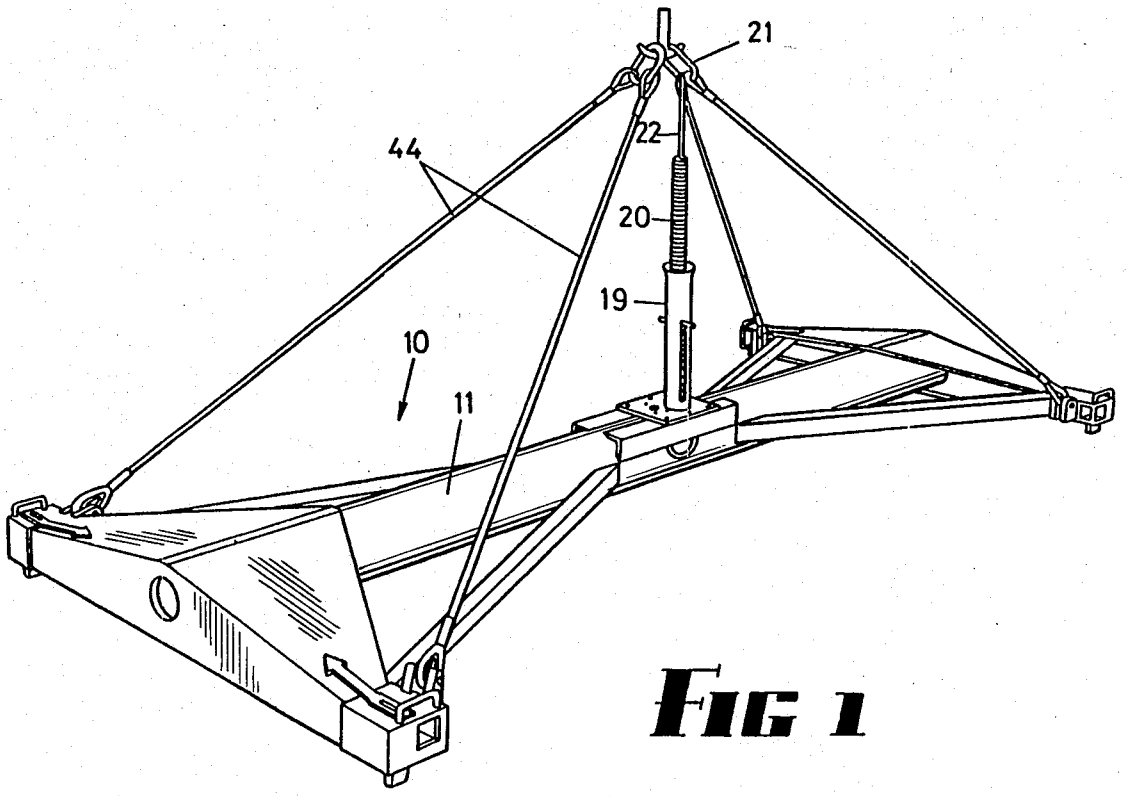
FIG. 1 is a perspective view of a spreader.
Figure 2:
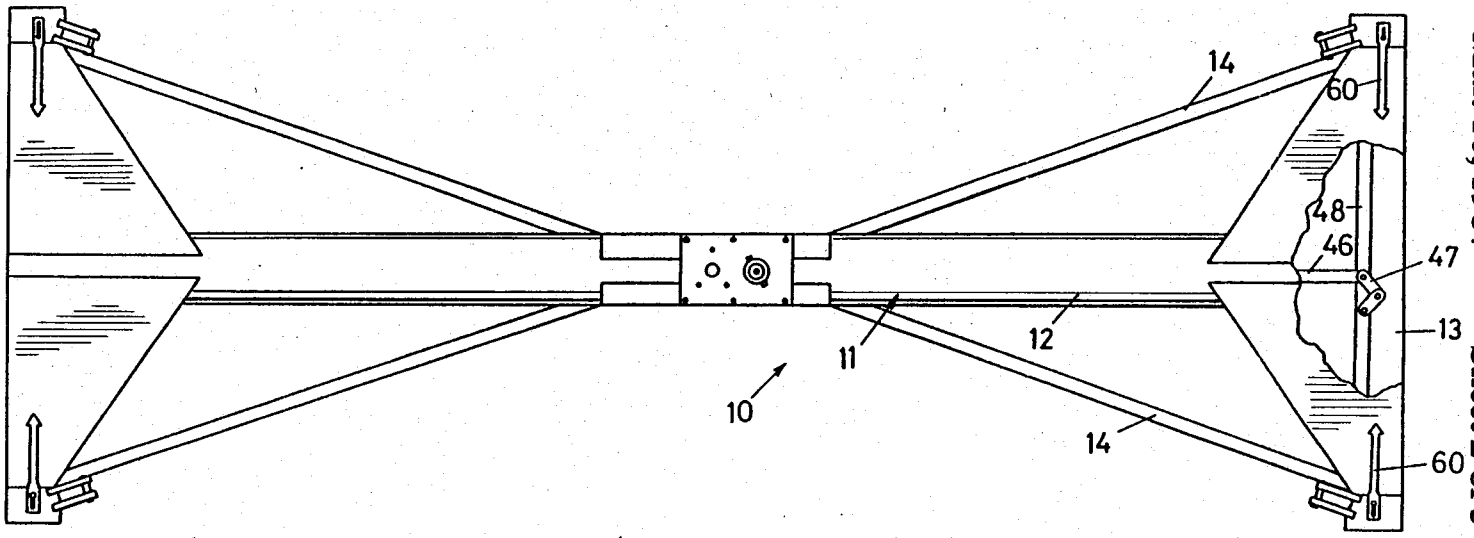
FIG. 2 is a plan view.
Figure 3:
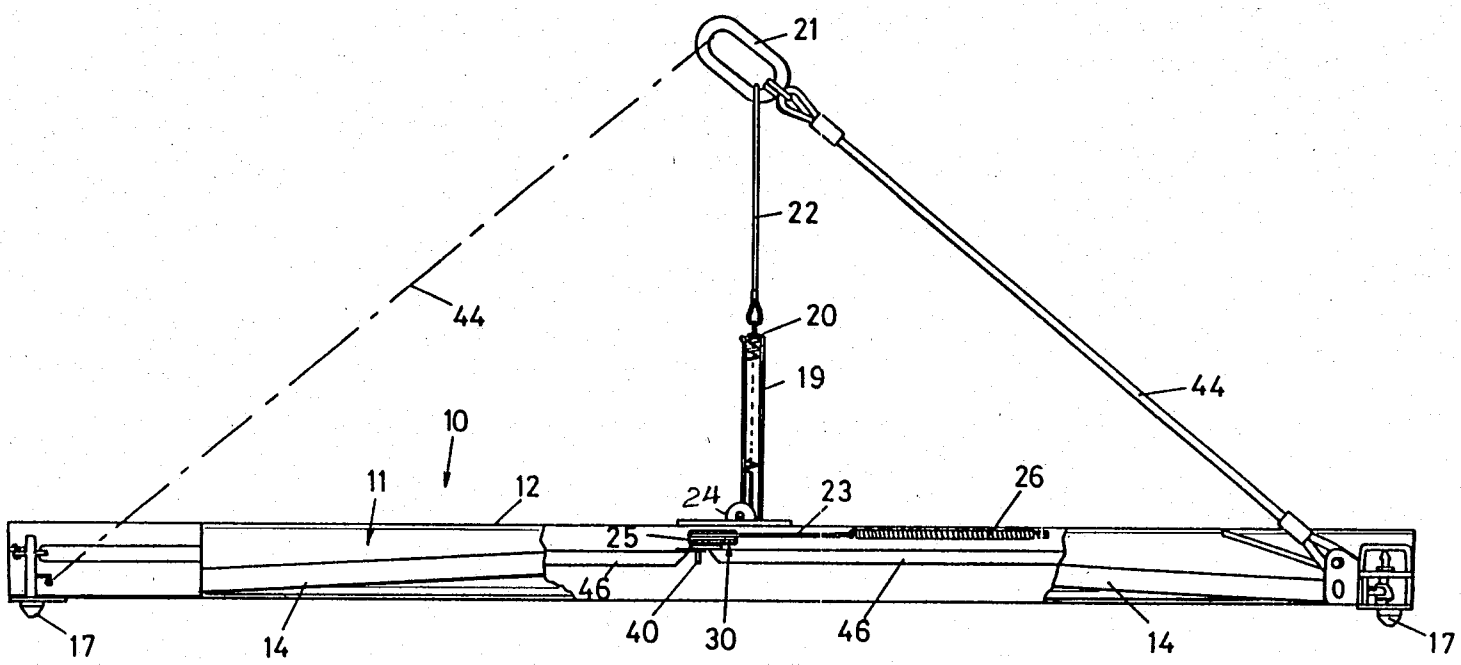
FIG. 3 is a side elevation.
Figure 4:
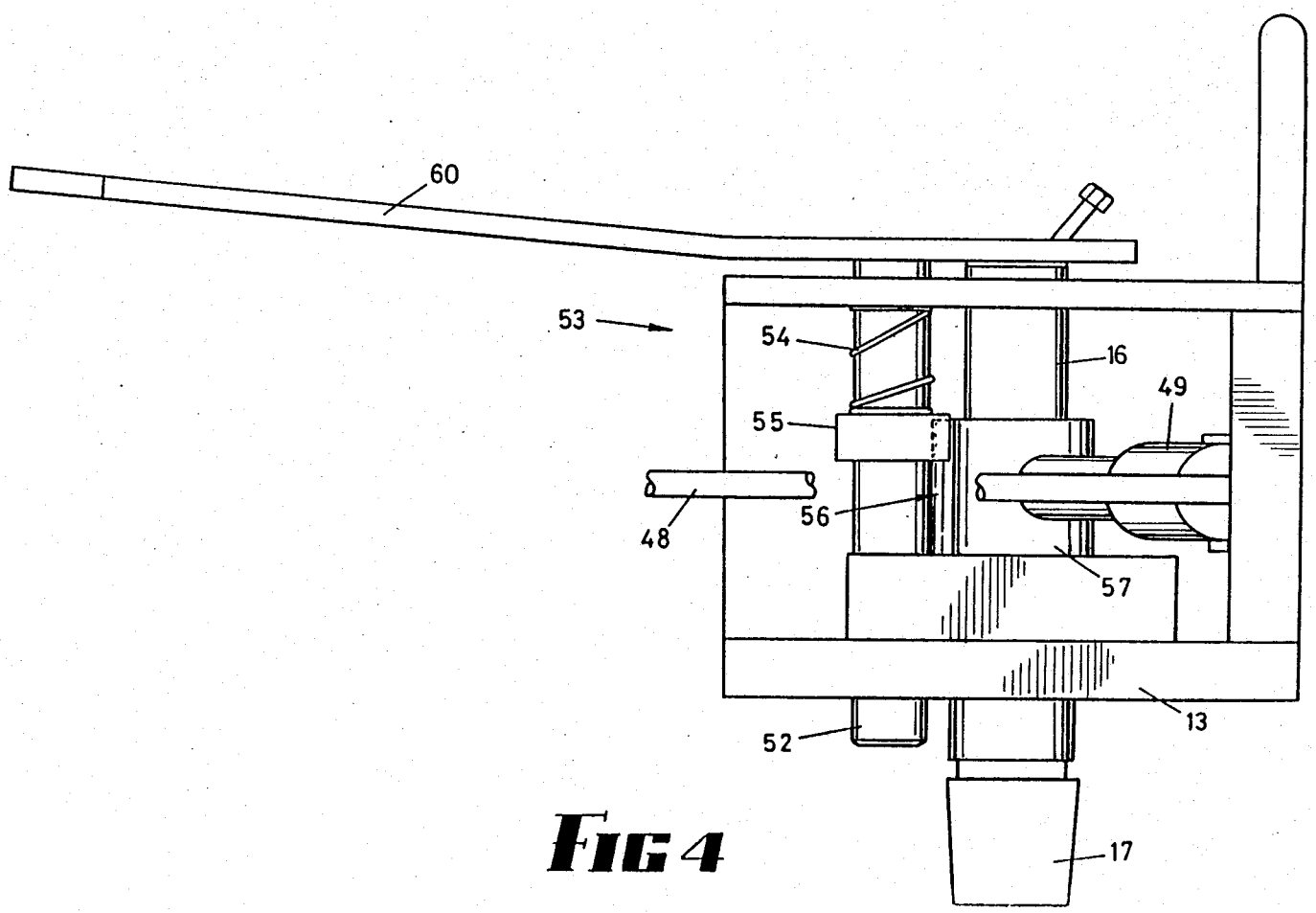
FIG. 4 is a fragmentary end elevation showing a twist-lock and its key means.
Figure 5:
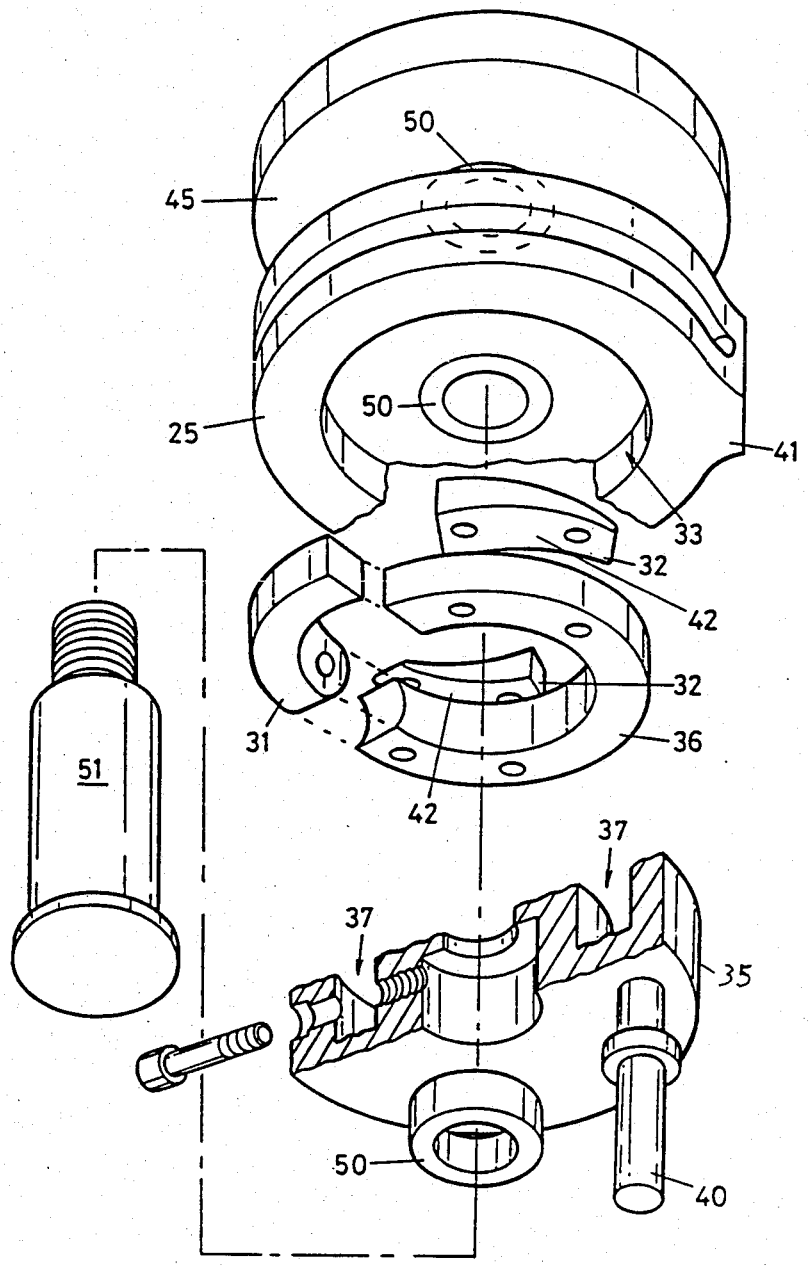
FIG. 5 is an "exploded" perspective view of the indexing head.

In this embodiment, a spreader 10 comprises a frame 11 provided with a longitudinal frame member 12 and two transverse frame members 13 one at each end, and diagonal stiffeners 14 between the central portion of the longitudinal member and the ends of the transverse frame members.

Each end of each transverse frame member is provided with bearing means supporting a twist lock spindle 16, and a twist lock key 17 is located on the lower end of the spindle 16.

The central portion of the longitudinal frame member has an upstanding tube 19 containing a first tensioning spring 20 which is coupled to a hoisting loop 21 by means of a spring tensioning cable 22. The lower end of the tensioning spring has a flexible cable 23 coupled to it and this passes over pulley 24 and around an indexing head drum 25, terminating at its other end in a return spring 26 (which is a second tensioning spring), the other end of the return spring 26 being anchored to the longitudinal frame member 12.

The indexing head 30 is provided with a ratchet pawl 31 which alternately engages with a ratchet stop block of a pair of blocks 32 contained in an annular slot 33 in drum 25, the arrangement being such that when the drum 25 is caused to rotate under the force applied to it by the first tensioning spring 20 when the hoisting loop 21 is lifted, one of the stop blocks 32 abuts the end of pawl 31 and causes lower plate 35 to rotate, since pawl 31 co-operates with part ring 36 to form a subassembly contained in annular slot 37 in lower plate 35. This carries the crank pin 40 with it through 180° of movement, further movement being inhibited by protuberance 41 of drum engaging an abutment (not shown) on frame member 12. Pawl 31 is urged into engagement with stop blocks 32 by spring means (not shown), but can ride over ramp surfaces 42 thereof in the return direction of rotation. When protuberance 41 strikes its abutmnt, further lifting force applied to hoisting loop merely tensions spring 20 until the lifting cables 44 become tensioned, to lift the spreader 10 and the container to which it is coupled by the four keys 17 of the respective twist locks. The indexing head drum 25 and the lower plate 35 are both carried by an upper plate 45 which is fixed to the longitudinal frame member, on bearings 50 which surround a central spindle 51.

When the lifting force is relaxed, and cables 44 become slack, spring 20 contracts and the second spring (return spring 26) reverses rotation of drum 25, but this does not cause any rotation of lower plate 25, since pawl 31 rides over the relevant stop block 32, as said above. That is, the keys 17 remain engaged in their respective lifing blocks. However, upon again applying a lifting force, the indexing head drum again rotates 180° in a forward direction, moving lower plate 35, with its crank pin 40, also through 180° to rotate lock keys 17 back into their disengaging positions, so that the spreader 10 lifts clear of its container.

The mechanism for achieving this is described hereunder:

The crank pin 40 is journalled in small bearings in the inner ends of two link bars 46 which extend in respective opposite directions from the crank pin.

The outer end of each link bar 46 is coupled to one leg of a respective bell crank 47, each bell crank 47 being pivotted intermediate its ends to a transverse frame member 13, and the outer leg being coupled to a twist lock actuating bar 48. Each outer end of the twist lock actuating bar 48 is coupled directly to an arm 49 on a respective twist lock spindle 16 in such a way that the bar directly controls movement of the twist lock spindle 16 (through an angle of 90° of rotation). However this movement is normally inhibited by four inhibit plungers 52 each projecting downwardly from a respective twist lock frame 53, and each inhibit plunger 52 is urged downwardly by a spring 54 within the twist lock frame 53. When the spreader frame however is positioned over a container to be hoisted, the lower ends of the inhibit plungers 52 abut the hollow lifting blocks, and the inhibit plungers are urged upwardly against their springs 54. Each inhibit plunger 52 carries an annular boss 55 intermediate its ends, which engages in a part circular groove 56 in the side wall of an annular nut 57 on its spindle 16. Only after this upward movement does boss 55 move free of abutment surface of the groove 56 to allow rotation of spindle 16. If a crane then applies an upward lift on the hoisting loop 21, the indexing head drum 25 rotates 180° as said above, the lower plate with its crank pin 40 is thereby rotated by 180° and the link bars 46 move within the longitudinal frame member 12 of the spreader 10 to in turn move the respective actuating bars 48 in a direction which results in the twist locks being rotated.

In the event however that any one of the inhibit plungers does not move upwardly, the relevant twist lock will be prevented from rotation, and this disables the outer three twist locks because the indexing head is itself prevented from its rotation. In such an instance, the hoist needs to be lowered and the tensioning spring relaxed, and if the displaced twist lock is then properly placed, and hoisting effort is again applied to the tensioning spring, the indexing head is free to rotate since there is nothing at that stage which will prevent movement of the actuating bars and consequential movement of the link bars. The next rotation of the indexing head will return the twist locks to their former positions.

In order to provide visual means which indicate to an operator that all twist locks are properly located, each twist lock spindle 16 has secured to it a pointer arm 60 which either points towards an open position or a locked position.

Each spindle nut 57 contains two grooves, but only one is engagable by a boss 55. This provides a means whereby only one shape of nut 57 is required for left/-right hand aspects.

The above description indicates the crank pin 40 depending from a lower plate 35, and the ratchet pawl 31 being carried by the lower plate 35 and engaging ratchet stop blocks 32 in the indexing head drum 25, but clearly rearrangement of these elements constitutes an obvious mechanical equivalent of the described structure.

A brief consideration of the above embodiment will indicate that the invention is very simple, but both reduces operator time and increases the safety associated with a spreader bar hoisting device.

The claims defining the invention are as follows:

I claim:

1. A spreader for transmitting a lifting force to twist lock blocks located at respective corners of a container when engaged by respective twist locks carried by the frame of the spreader, wherein each said twist lock comprises a twist lock spindle having an arm projecting therefrom, comprising:

a longitudinal frame member and a pair of transverse frame members at respective ends of the longitudinal frame member, said twist locks being at respective ends of the transverse frame members, a lifting member, lifting cables extending from the lifting member to the spreader frame, an indexing head on the spreader frame, spring means between the indexing head and the lifting member, a pair of bell cranks one at each respective end of said longitudinal frame member, link bar means coupled to said indexing head and to said bell cranks, and twist lock actuating bars carried by respective transverse frame member connecting each said bell crank to both said twist lock arms on a respective said transverse frame member, so arranged that rotation of the indexing head moves the link bars longitudinally and the actuating bars transversely to effect said simultaneous rotation of the twist locks, and inhibit means operable between each respective said twist lock and the frame arranged such that if any one of the twist locks does not rotate to a locking position upon said lifting force being applied, the inhibit means inhibits movement of the coupling means which in turn disables the indexing head from rotation and thereby all other twist locks are prevented from rotation.

2. A spreader for transmitting a lifting force to twist lock blocks according to claim 1 further characterised in that said lifting member comprises a lifting loop.

3. A spreader for transmitting a lifting force to twist lock blocks according to claim 1 further characterised in that said indexing head comprises a central spindle having bearings thereon which support an indexing head drum and a lower plate for rotation, the lower plate having a crank pin depending therefrom which engages said link bar miner ends.

4. A spreader for transmitting a lifting force to twist lock blocks according to claim 3 further characterised in that said spring means between the indexing head and the lifting member comprise a first tensioning spring coupled at one end to said lifting member, and a cable coupling the other end of the first tensioning spring to one end of a second tensioning spring the other end of which is secured to the spreader frame, said cable extending around and being secured intermediate its ends to the indexing head drum.

5. A spreader for transmitting a lifting force to twist lock blocks according to claim 3 further characterised in that said indexing head drum comprises an outstanding protuberance engageable against abutment means on the spreader which limits rotation of said drum to one half revolution.

6. A spreader for transmitting a lifting force to twist lock blocks according to claim 3 further characterised in that one of (a) said indexing head drum, and (b) said lower plate, comprises a ratchet pawl and the other comprises a pair of ratchet stop blocks diametrically opposite each other and successively engageable by said ratchet pawl, so arranged that each half revolution of the indexing head drum in one direction effects a corresponding half revolution of the lower plate in that said direction, but rotation of said drum in the opposite direction does not cause rotation of the lower plate.

7. A spreader for transmitting a lifting force to twist lock blocks according to claim 1 further characterised in that each said inhibit plunger has a boss thereon, each said twist lock spindle having an axially extending groove in its side wall, and said inhibit means further comprises spring means urging each said inhibit plunger downwardly so that its boss engages in said groove, the lower end of each said plunger projecting downwardly from the spreader frame, but engaging an upper surface of the container when the spreader frame is lowered onto the container, and being urged upwardly thereby against its said spring and disengaging its boss from engagement with the groove walls of its twist lock spindle.

8. A spreader for transmitting a lifting force to twist lock blocks located at respective corners of a container when engaged by respective twist locks carried by the spreader, the spreader comprising:

a generally rectangular spreader frame having twist locks located at its respective corners for engaging respective twist lock blocks located at the corners of a container, each twist lock being rotatable between a released position and a locked position;

a lifting member and lifting cables extending from the lifting member to the spreader frame;

an indexing head on the spreader frame, and spring means between the indexing head and the lifting member;

coupling means for coupling the indexing head to the respective twist locks for rotating the twist licks simultaneously into their locked positions on application of a lifting force to the lifting member;

inhibit means between each twist lock and the frame for preventing rotation of the respective twist lock, each said inhibit means being movable between a position preventing rotation of the respective twist lock and a released position allowing rotation of the twist lock on engagement with the upper surface of a container;

said coupling means further comprising means for disabling said indexing head and preventing rotation of all the twist locks if any of the inhibit means is not released to allow rotation of its respective twist lock.

* * * * *

UNITED STATES PATENT AND TRADEMARK OFFICE

CERTIFICATE OF CORRECTION

PATENT NO. : 4,648,645

DATED : March 10, 1987

INVENTOR(S) : SVEN-OLAF LUNDGREN

It is certified that error appears in the above-identified patent and that said Letters Patent is hereby corrected as shown below:

On the title page
In the name of Inventor, Column 1, delete "Sven-Olov" and insert--Sven-Olaf--.

Signed and Sealed this

Twenty-sixth Day of April, 1988

*Attest:*

DONALD J. QUIGG

*Attesting Officer*

*Commissioner of Patents and Trademarks*